US010520860B2

(12) United States Patent
Finkelman et al.

(10) Patent No.: US 10,520,860 B2
(45) Date of Patent: Dec. 31, 2019

(54) ELECTRICAL BLANKET CONDITIONING

(71) Applicant: HP INDIGO B.V., Amstelveen (NL)

(72) Inventors: Ido Finkelman, Ness Ziona (IL); Rivay Mor, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/098,171

(22) PCT Filed: Jul. 14, 2016

(86) PCT No.: PCT/EP2016/066814
§ 371 (c)(1),
(2) Date: Nov. 1, 2018

(87) PCT Pub. No.: WO2018/010805
PCT Pub. Date: Jan. 18, 2018

(65) Prior Publication Data
US 2019/0146379 A1 May 16, 2019

(51) Int. Cl.
*G03G 15/16* (2006.01)

(52) U.S. Cl.
CPC ..... *G03G 15/161* (2013.01); *G03G 2215/16* (2013.01)

(58) Field of Classification Search
CPC . G03G 15/161; G03G 15/168; G03G 2215/16
See application file for complete search history.

(56) References Cited

U.S. PATENT DOCUMENTS 5,438,398 A * 8/1995 Tanigawa ..... G03G 15/0131 399/302
6,016,415 A * 1/2000 Herrick ..... G03G 15/1685 399/162
7,204,584 B2 4/2007 Lean et al.
8,731,436 B2 5/2014 Gamzon-Kapeller et al.
2003/0231892 A1* 12/2003 Miyake ..... G03G 15/168 399/66
2008/0080884 A1 4/2008 Yamane
2010/0111559 A1* 5/2010 Ziegelmuller ..... G03G 15/168 399/101
2011/0014557 A1 1/2011 Kim et al.
2011/0217082 A1 9/2011 Frydman et al.
2015/0277264 A1 10/2015 Chang et al.

FOREIGN PATENT DOCUMENTS

EP 0684527 A1 11/1995
WO WO-2016000747 1/2016

OTHER PUBLICATIONS

HP Indigo Digital Offset Color Technology, Mar. 2015, < http://www8.hp.com/h20195/v2/GetPDF.aspx/4AA1-5248ENW.pdf >.

* cited by examiner

*Primary Examiner* — Sandra Brase
(74) *Attorney, Agent, or Firm* — Middleton Reutlinger

(57) ABSTRACT

According to an aspect there is provided a method for conditioning a blanket in an offset printer, the method comprising during a non-printing cycle of the offset printer, applying a first voltage to an intermediate transfer member of the offset printer, wherein the intermediate transfer member comprises the blanket, and maintaining the first voltage for a first period of time.

11 Claims, 3 Drawing Sheets

ELECTRICAL BLANKET CONDITIONING

BACKGROUND

Image forming apparatus, such as a liquid electrostatic printing apparatus, generally include an image transfer blanket that receives images formed on an imaging member and transfer the image onto a substrate such as print media.

Typically, charged, liquid ink is electrically transferred from an imaging plate to the blanket when the blanket and imaging plate rotate into contact. In the region where the blanket and the imaging plate come into contact, ink drops are compressed into the nip while experiencing shear forces, which can result in smearing of ink dots. The level of smearing may be particularly dependent on the level of ink-blanket adhesion.

BRIEF INTRODUCTION OF THE DRAWINGS

Examples of the invention are further described hereinafter with reference to the accompanying drawings, in which.

DETAILED DESCRIPTION

Figure 1:
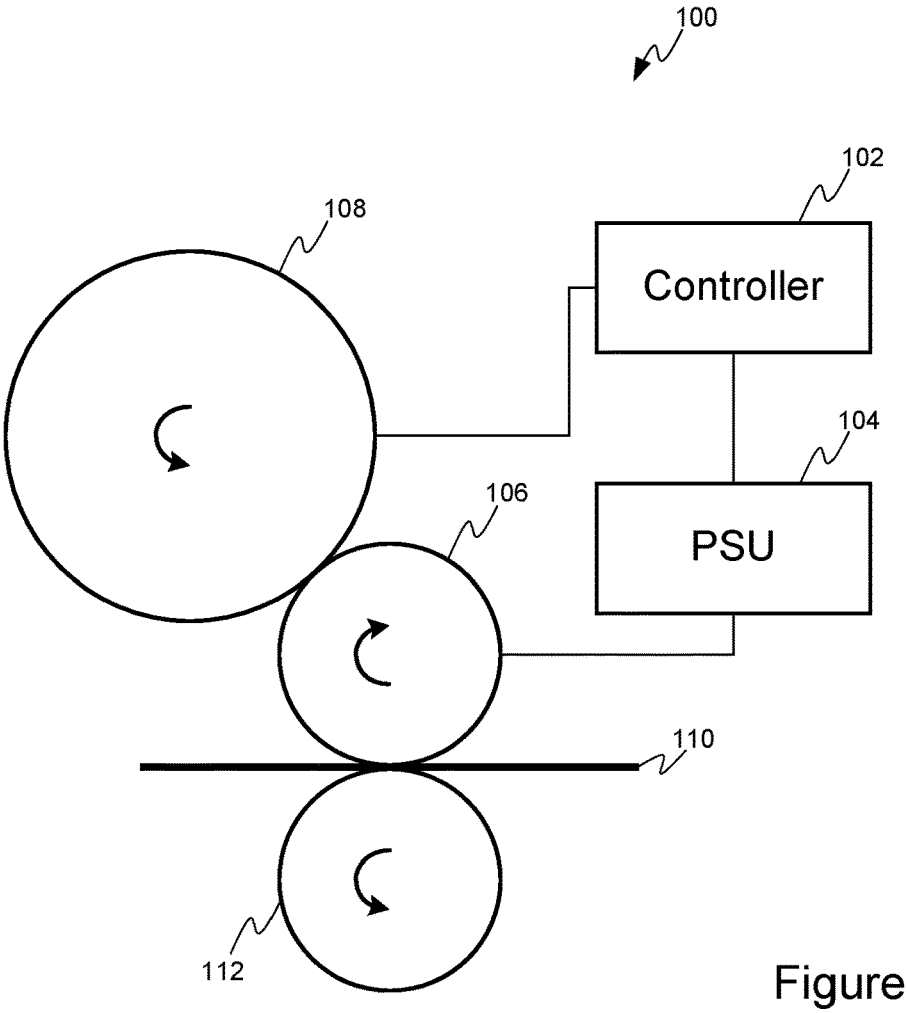
FIG. 1 is a block diagram of an image forming apparatus including an example intermediate transfer member comprising a transfer blanket.

Examples provide a method of reducing the ink-blanket adhesion in an image forming apparatus including a transfer blanket, such as an offset printer, by increasing the blanket surface releasability.

Releasability is the ability of the blanket to transfer ink from the blanket to the substrate. This can be achieved by reducing the ink-blanket adhesion. However, very poor adhesion will not enable transferring ink from the PIP to the blanket. The releasability in PIP-blanket transfer, where ink is still in liquid form, is determined by the degree of blanket surface polarity. Extremely hydrophilic surface will not allow ink transfer whereas extremely hydrophobic surface will lead to increase wetting, and in turn to ink smearing.

In offset printing process the transfer blanket is used as an intermediate carrier of ink from a photoconductive image plate (PIP) to a substrate, such as a print medium. The transfer of ink between the PIP and the blanket may be induced by an electrical bias, by mechanical pressure, or both.

The compressible transfer blanket may be mounted over an intermediate transfer metal cylinder (ITM), allowing the pressure between the PIP and the ITM, and between the ITM and an impression cylinder (substrate), to be adjusted and to ensure good print quality.

The surface texture of the transfer blanket may have an impact on the transfer of ink from the PIP to the blanket and from the blanket to the print medium. In some examples, the rubber blanket is coated with a polymer layer of few microns (called a release layer) to allow both transfer of the electrostatic latent image from the PIP to the blanket and transfer of ink when pressed against a substrate. The releasability of this top layer can affect the ability of the image forming apparatus to provide good transfer of ink to the substrate. The transfer blanket surface properties should allow good ink transfer between the PIP and blanket.

Following curing, heating and other production processes, chemical byproducts may diffuse out of the release layer onto the surface of the transfer blanket. Together with possible exposure to organic pollutants during shipment to customers, these contaminations may make the blanket surface more hydrophobic.

One manifestation of poor releasability on print is in transfer between the PIP and the blanket. Depending on the transmission ratio between the PIP and ITM cylinders, the ink droplets may experience shear forces within the nip. Considering the mechanical design of the ITM and PIP cylinders, the linear movement within the nip may be up to tens of microns. Whether the ink droplet would tear apart or maintain its shape depends, among other aspects, on the blanket surface polarity. As a blanket surface becomes more hydrophobic the ink droplets smearing can increase.

The forces applied to the ink droplet during transfer are both mechanical and electrical. Since the ink droplet at the point of transfer has not yet undergone drying and heating (and may be diluted with a solvent such as isopar oil), sufficient releasability is crucial to ensure the ink droplet does not deform and smear during the transfer. Such smearing may manifest as instability of optical density and colour, resulting in poor print quality.

Further, to ensure good print quality and consistent output by the image forming apparatus the releasability should be preserved with age despite constant interaction with ink, imaging oil, and the substrate surface. However, in practice the release properties of the transfer blanket may vary with the age of the blanket due to the interaction with ink, and therefore smearing may change at different rates, depending on the ink coverage, for different portions of the transfer blanket. This difference may over time be highlighted as a variation in dot gain and optical density between areas, which may appear as memory on half-tone coverage.

Reductions in dot smearing can be facilitated by printing a number of uniform, high-coverage, images. However, to significantly reduce or eliminate dot smearing may require the printing of tens of copies resulting in an increase in paper waste and ink consumption as well as decrease in productivity.

According to a disclosed method the ink-blanket adhesion may be reduced by increasing the blanket surface polarity. This may be achieved by applying an electric bias of hundreds of volts to the transfer blanket for a few minutes while the press is rotating at full speed in a non-printing mode. The proposed action may be performed immediately following the installation of a fresh blanket to condition the new transfer blanket.

FIG. 1 is a block diagram of an image forming apparatus, for example an offset printer, including a transfer blanket. Referring to FIG. 1, the image forming apparatus 100 includes an imaging member such as photo imaging plate (PIP) 108 that defines an outer surface on which images can be formed. For example, the outer surface can be charged with a suitable charger (not shown) such as a charge roller, and portions of the outer surface that correspond to features of the image can be selectively discharged, for example by a laser writing unit, to form an electrostatic image on the outer surface of the PIP. A fluid such as ink, or pigment contained in the ink, can then be applied to the electrostatic image to form an ink image on the outer surface.

The ink image formed on the outer surface of the PIP 108 is transferred to an intermediate transfer member 106, such as an intermediate transfer metal cylinder, which includes an image transfer blanket. The intermediate transfer member can receive the ink image from the PIP and transfer the image to the substrate 110. During the transfer from the intermediate transfer member 106 to the substrate 110, the substrate 110 is pinched between the intermediate transfer member 106 and an impression member 112. Once the ink image has been transferred to the substrate, the substrate can be transported to an output.

The image forming apparatus 100 further includes a controller 102 for controlling functions of the apparatus and a power supply 104, such as an intermediate transfer member power supply, operable to apply a voltage to the image transfer member 106 during printing to aid transfer of ink.

Figure 2:
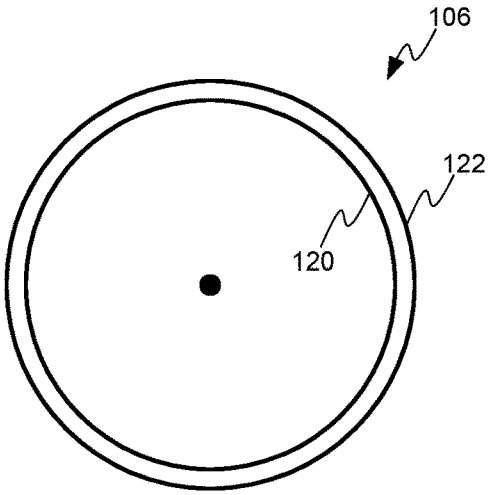
FIG. 2 is a side view of the example intermediate transfer member of FIG. 1.

FIG. 2 is a side view illustrating the image transfer member 106. The image transfer blanket 122 may be mounted on and overlie an outer surface of an intermediate transfer metal cylinder 120. More particularly, the image transfer blanket 122 may be securely attached to the outer surface of the intermediate transfer cylinder 120.

Repeated printing over time may lead to wear of the transfer blanket 122, and in particular the release layer of the transfer blanket 122. Thus, the blanket may be replaceable, allowing a new transfer blanket to be mounted on the intermediate transfer cylinder 120.

According to some example, to adjust the releasability of the transfer blanket 122, and consequently improve the print quality performance, a phase of electric conditioning may be performed immediately after installing a fresh blanket.

Blanket replacement may trigger a number of basic procedures the image forming apparatus is expected to perform in order to compensate for blanket-to-blanket variations and meet proper print quality conditions. As one of these procedures, the controller 102 may cause the power supply 104 to apply a working voltage, which is normally applied during printing, to the intermediate transfer member during a non-printing mode of the apparatus. For example, the working voltage may be 550 volts. This results in an electric bias being applied across the blanket.

Furthermore, the controller 102 may cause the PIP 108 to be charged to a second voltage, for example −1000 volts, by the charge roller, and then discharged before engaging the blanket. A residual charge of several tens of volts may remain on the PIP after being discharged, increasing the total electric bias applied to the transfer blanket 122. For example, the total electric bias may be in the region of 600 volts.

According to some examples, during a predetermined amount of time of a blanket conditioning period, the controller may cause multiple cycles of charging, discharging and engaging of the PIP 108 such that the total electric bias applied to the transfer blanket 122 is maintained at the desired value.

Figure 4:
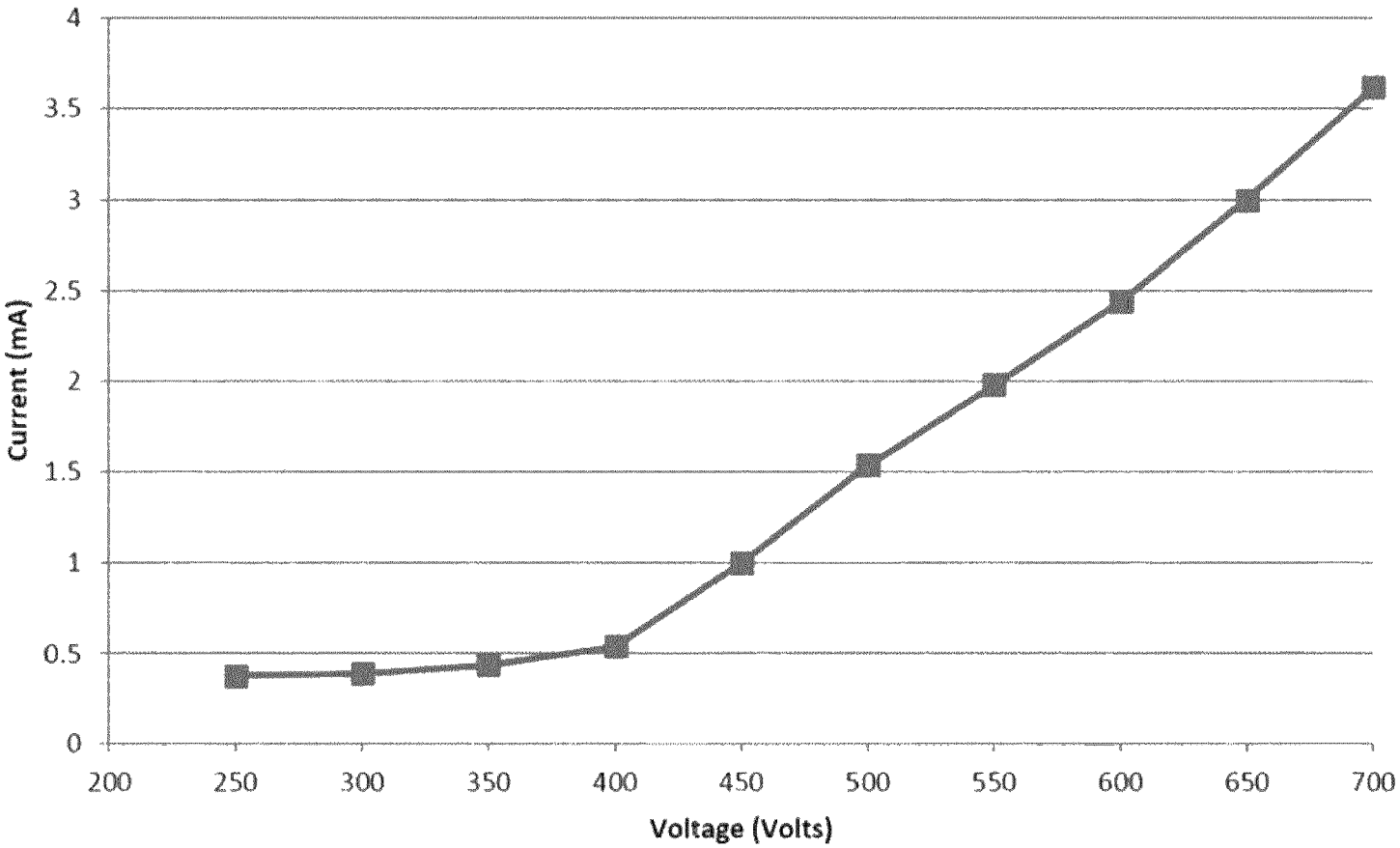
FIG. 4 is a graph of measured current against a voltage applied to an example intermediate transfer member due to breakdown in the gaseous surroundings of the blanket.

The electric bias has been observed from empirical results, as well as determined from hardware limitations. FIG. 4 illustrates measurements of current through the ITM power supply 104. As can be seen in FIG. 4, the measured current shows an increasing trend with increasing the ITM voltage. At about 400 volts a sharp change in slope can be seen which can be explained by an electric breakdown through the gaseous surroundings of the blanket 122.

This electric breakdown may act to ionize the Oxygen in the atmosphere surrounding the blanket and consequently lead to oxidization of the blanket surface. In particular, the silicon surface, as well as any organic contaminations present on the surface of the blanket, may be oxidized leading to the surface becoming more hydrophilic. Since the conditioning effect on blanket surface is cumulative, the electric field may be regularly applied for a few minutes during non-printing cycles which ensures that the surface becomes sufficiently hydrophilic to reduce or prevent smearing of the ink droplets.

However, dramatic increase in the hydrophilic property of the blanket surface may emphasize print quality defects related with structure inhomogeneity of the release layer. In addition, increasing the voltage beyond the designed working voltage used during printing may risk breakdown through the blanket surface itself, permanently damaging it. Alternatively, voltages to be used for conditioning the transfer blanket 122 may be different from the working voltage and may be determined, for example empirically, to provide the best conditioning effect for the blanket.

Figure 3:
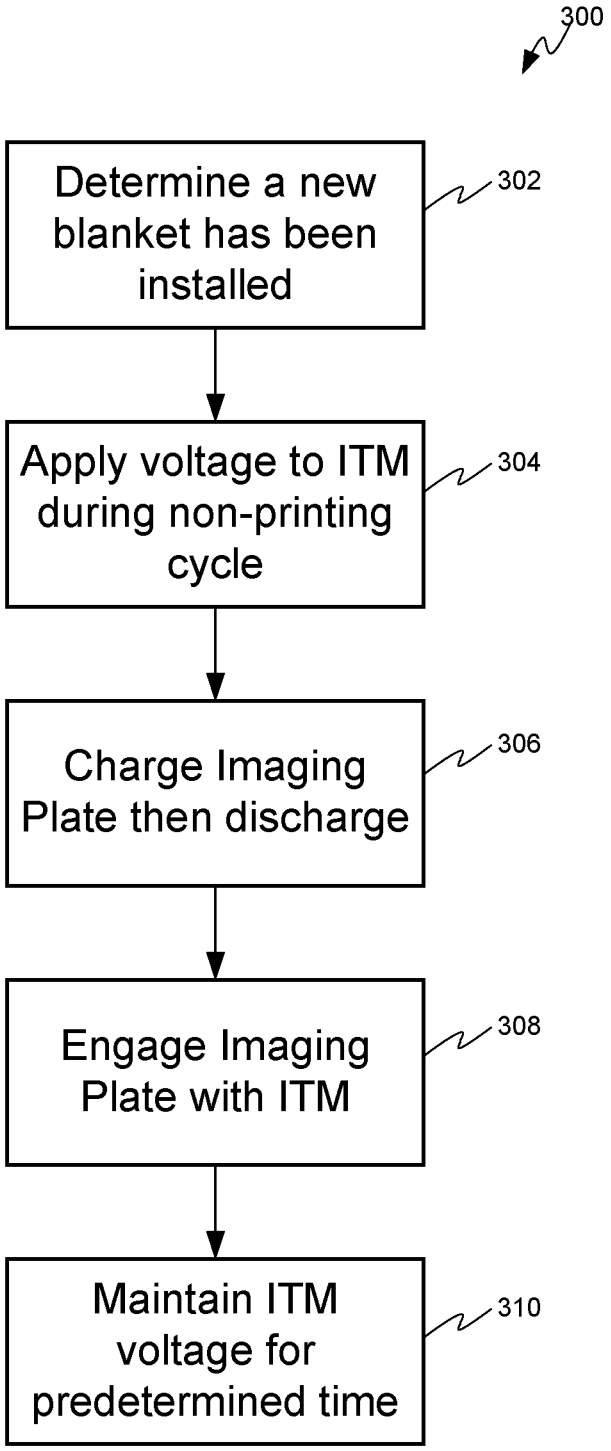
FIG. 3 is a block diagram of an example method of conditioning a transfer blanket.

FIG. 3 illustrates a method 300 of conditioning a transfer blanket 122 in an image forming apparatus according 100 to examples. According to the method 300 of FIG. 3, the method begins in response to a determination 302 that a new blanket has been installed. A voltage, such as a working voltage, is applied to the intermediate transfer member 106 during a non-printing cycle of the image forming apparatus 100. The imaging member 108 is also charged 304 and then discharged 306 before being engaged 308 with the intermediate transfer member 106. The voltage applied to the intermediate transfer member 106 is then maintained 310 for a predetermined time, for example a number of minutes, to condition the blanket prior to printing.

According to some examples, the method may comprise multiple cycles of steps 306 and 308 whereby the imaging plate is charged, discharged and the engaged with the surface of the transfer blanket 122 during the predetermined time for which the intermediate transfer member 106 voltage is maintained. This helps to provide a constant bias voltage to the blanket 122 which would otherwise reduce as the residual charge on the imaging plate 108 discharges during conditioning.

As discussed above, the conditioning method may also be performed at regular intervals during non-printing cycles of the image forming apparatus 100 rather than in response to a new blanket having been installed.

In some examples, the controller 102 may comprise a processor and a memory/storage. The memory/storage may be used to load and store data and/or instructions to allow the processor to implement any method as described above. The memory/storage may comprise any computer readable medium capable of storing the instructions, for example, a read-only memory, a random access memory, cache, etc.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method for conditioning a blanket in an offset printer, the method comprising:

during a non-printing cycle of the offset printer, applying a first voltage to an intermediate transfer member of the offset printer, wherein the intermediate transfer member comprises the blanket;

maintaining the first voltage for a first period of time; and during the same non-printing cycle, conditioning the blanket, wherein the conditioning comprises:

applying a second voltage to an imaging plate, wherein the second voltage has an opposite polarity of the first voltage, discharging the imaging plate, and while maintaining application of the first voltage to the intermediate transfer member, engaging the imaging plate with the intermediate transfer member.

2. The method of claim 1, wherein the first voltage comprises a working voltage of the intermediate transfer member.

3. The method of claim 1, wherein the intermediate transfer member further comprises an intermediate transfer metal cylinder, wherein the blanket is mounted on the intermediate transfer metal cylinder.

4. The method of claim 3 further comprising:

determining whether a new blanket has been mounted on the intermediate transfer metal cylinder; and applying the first voltage during the non-printing cycle in response to determining that a new blanket has been mounted.

5. The method of claim 4, further comprising applying the first voltage during further non-printing cycles at periodic intervals to further condition a blanket.

6. A controller for use in an image forming apparatus, the controller comprising:

a processor; and a memory comprising instructions that when executed on the processor cause the image forming apparatus to:

apply a first voltage to an intermediate transfer member of the image forming apparatus during a non-printing cycle of the image forming apparatus, wherein the intermediate transfer member comprises a blanket;

maintain the first voltage for a first period of time; and during the same non-printing cycle, condition the blanket, wherein to condition the blanket, the image forming apparatus is to:

apply a second voltage to an imaging plate, discharge the imaging plate, and during the first period of time, engage the imaging plate with the intermediate transfer member.

7. The controller of claim 6, wherein the instructions are further to cause the image forming apparatus to:

determine whether a new blanket has been installed; and in response to determining that the new blanket has been installed, applying the first voltage to the intermediate transfer member.

8. The controller of claim 6, wherein the first voltage comprises a working voltage of the intermediate transfer member.

9. An image forming apparatus comprising:

an intermediate transfer member, the intermediate transfer member comprising a blanket;

an imaging plate, operable to engage the intermediate transfer member;

a power supply operable to supply a voltage to the intermediate transfer member; and a controller to cause the power supply to:

apply a first voltage to the intermediate transfer member for a first period of time during a non-printing cycle of the image forming apparatus during the same non-printing cycle, condition the blanket, wherein to condition the blanket, the controller is to:

apply a second voltage to an imaging plate, discharge the imaging plate, and during application of the first voltage to the intermediate transfer member, engage the imaging plate with the intermediate transfer member.

10. The offset printer of claim 9, wherein the intermediate transfer member further comprises an intermediate transfer metal cylinder, wherein the blanket is mounted on the intermediate transfer metal cylinder.

11. A non-transitory computer readable medium comprising computer program code configured when executed on a processor to cause an offset printer to implement a method comprising:

during a non-printing cycle of the offset printer, apply a first voltage to an intermediate transfer member of the offset printer, wherein the intermediate transfer member comprises a blanket; and maintain the first voltage for a first period of time;

during the same non-printing cycle, condition the blanket, wherein to condition the blanket, the offset printer is to:

apply a second voltage to an imaging plate, discharge the imaging plate, and during maintenance of the first voltage, engage the imaging plate with the intermediate transfer member.

* * * * *